US009539825B2

(12) United States Patent
Sasaki et al.

(10) Patent No.: US 9,539,825 B2
(45) **Date of Patent: *Jan. 10, 2017**

(54) PRINTING DEVICE

(71) Applicant: SEIKO EPSON CORPORATION, Tokyo (JP)

(72) Inventors: Tsuneyuki Sasaki, Nagano (JP); Shuichiro Nakano, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/979,961

(22) Filed: Dec. 28, 2015

(65) Prior Publication Data

US 2016/0129703 A1 May 12, 2016

Related U.S. Application Data

(63) Continuation of application No. 14/230,433, filed on Mar. 31, 2014, now Pat. No. 9,254,686.

(30) Foreign Application Priority Data

Apr. 8, 2013 (JP) ..... 2013-080513

(51) Int. Cl.
*B41J 11/00* (2006.01)
*B41M 7/00* (2006.01)

(52) U.S. Cl.
CPC ..... *B41J 11/002* (2013.01); *B41M 7/00* (2013.01)

(58) Field of Classification Search
CPC ..... B41J 11/002; B41M 7/00
See application file for complete search history.

(56) References Cited

U.S. PATENT DOCUMENTS

| | | | | |
|---|---|---|---|---|
| 6,498,203 | B1 | 12/2002 | Kito et al. | |
| 9,254,686 | B2 * | 2/2016 | Sasaki | B41J 11/002 |
| 2003/0169322 | A1 | 9/2003 | Shima et al. | |
| 2010/0188455 | A1 * | 7/2010 | Shinkawa | B41J 2/155 347/16 |
| 2011/0091249 | A1 | 4/2011 | Murakami et al. | |
| 2011/0157286 | A1 | 6/2011 | Ikegami et al. | |
| 2012/0249703 | A1 * | 10/2012 | Nishimura | B41J 11/002 347/102 |

FOREIGN PATENT DOCUMENTS

JP 2003-237049 A 8/2003

* cited by examiner

*Primary Examiner* — Manish S Shah
*Assistant Examiner* — Yaovi M Ameh
(74) *Attorney, Agent, or Firm* — Global IP Counselors, LLP

(57) ABSTRACT

A printing device includes a device main body that has a feeding unit to feed a recording medium and a printing section to print by ejecting ink from a head onto the recording medium, and a heating unit disposed on a downstream side in a feed direction of the recording medium with respect to the device main body. The heating unit has a medium passage to pass the recording medium after printing therethrough, a heat generator disposed between the medium passage and the air passage in a sectional view of the heating unit to heat the recording medium after printing, and an air passage having an air aspirating port connected with the medium passage to aspirate air and an air discharging port to discharge air. The air aspirating port is located on an upstream side in a feed direction of the recording medium with respect to the air discharging port.

10 Claims, 4 Drawing Sheets

PRINTING DEVICE

CROSS-REFERENCE TO RELATED APPLICATIONS

This is a continuation application of U.S. patent application Ser. No. 14/230,433, filed on Mar. 31, 2014, which claims priority to Japanese Patent Application No. 2013-080513 filed on Apr. 8, 2013. The entire disclosures of U.S. patent application Ser. No. 14/230,433 and Japanese Patent Application No. 2013-080513 are hereby incorporated herein by reference.

BACKGROUND

Technical Field

The present invention relates to a printing device.

Background Technology

In order to conduct printing to a relatively large poster, a printing device for conducting printing by drawing a recording medium wound in a roll shape and applying ink to the drawn recording medium (for example, see Patent Document 1). The printing device described in Patent Document 1 includes a feed mechanism for drawing a recording medium wound in a roll shape and feeding the recording medium, a head (printing head) for applying ink to the recording medium that has been fed, a heating mechanism (heating means or heating unit) for heating and drying the ink on the recording medium, and a casing body (case) for collectively accommodating these mechanisms. In a printing device of such a configuration, when t recording medium is heated with a heating mechanism, moisture or the like in ink on the recording medium stays within a casing body as vapor, which causes condensation to occur in the casing body. As a result, there is a problem that a recording medium gets wet after printing.

Japanese Laid-open Patent Publication No. 2003-237049 (Patent Document 1) is an example of the related art.

SUMMARY

Problems to be Solved by the Invention

The advantage of the invention is to provide a printing device that can prevent condensation from occurring in a heating unit.

Means Used to Solve the Above-Mentioned Problems

The advantage is achieved by the invention described below. According to one aspect of the invention, a printing device includes a device main body that has a feeding unit configured and arranged to feed a recording medium and a printing section configured and arranged to print by ejecting ink from a liquid drop ejecting head onto the recording medium that has been fed by activation of the feeding unit, and a heating unit disposed on a downstream side in a feed direction of the recording medium with respect to the device main body, the heating unit having a medium passage, a heat generator, and an air passage provided independently of the medium passage. The medium passage is configured and arranged to pass the recording medium after printing therethrough. The heat generator is disposed between the medium passage and the air passage in a sectional view of the heating unit to heat the recording medium after printing with heat generated by the heat generator. The air passage has an air aspirating port that is connected with the medium passage so as to aspirate air in the medium passage and an air discharging port that is provided in a position different from the air aspirating port so as to discharge air aspirated through the air aspirating port, with the air aspirating port being located on an upstream side in a feed direction of the recording medium with respect to the air discharging port.

BRIEF DESCRIPTION OF THE DRAWINGS

Referring now to the attached drawings which form a part of this original disclosure.

DETAILED DESCRIPTION OF EXEMPLARY EMBODIMENTS

Hereinafter, a printing device of the invention will be explained in detail based on a preferred embodiment shown in the attached drawings.

<Printing Device>

Figure 1:
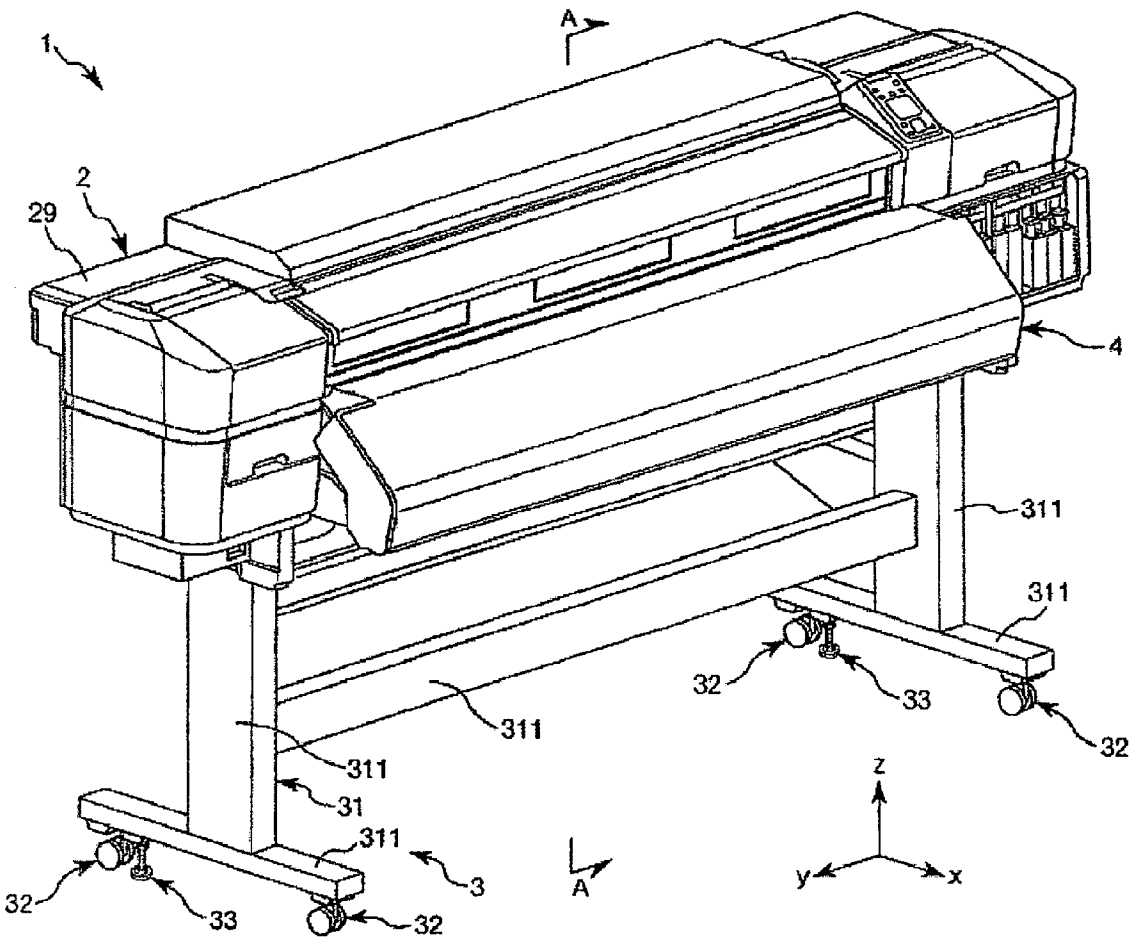
FIG. 1 is a perspective view of a printing device according to the invention.
Figure 2:
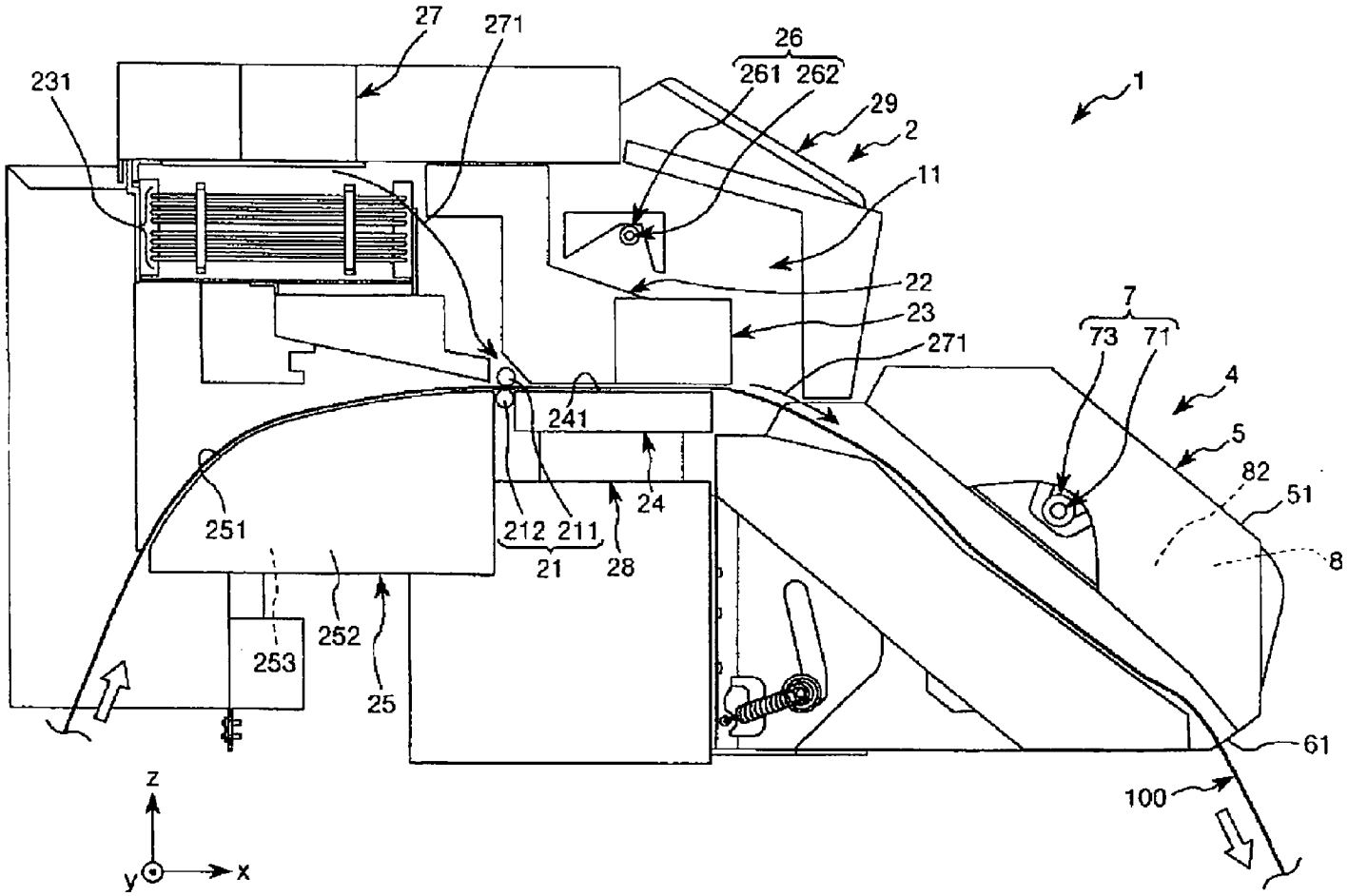
FIG. 2 is a sectional view of A-A line of FIG. 1 (schematic cross-sectional view)
Figure 3:
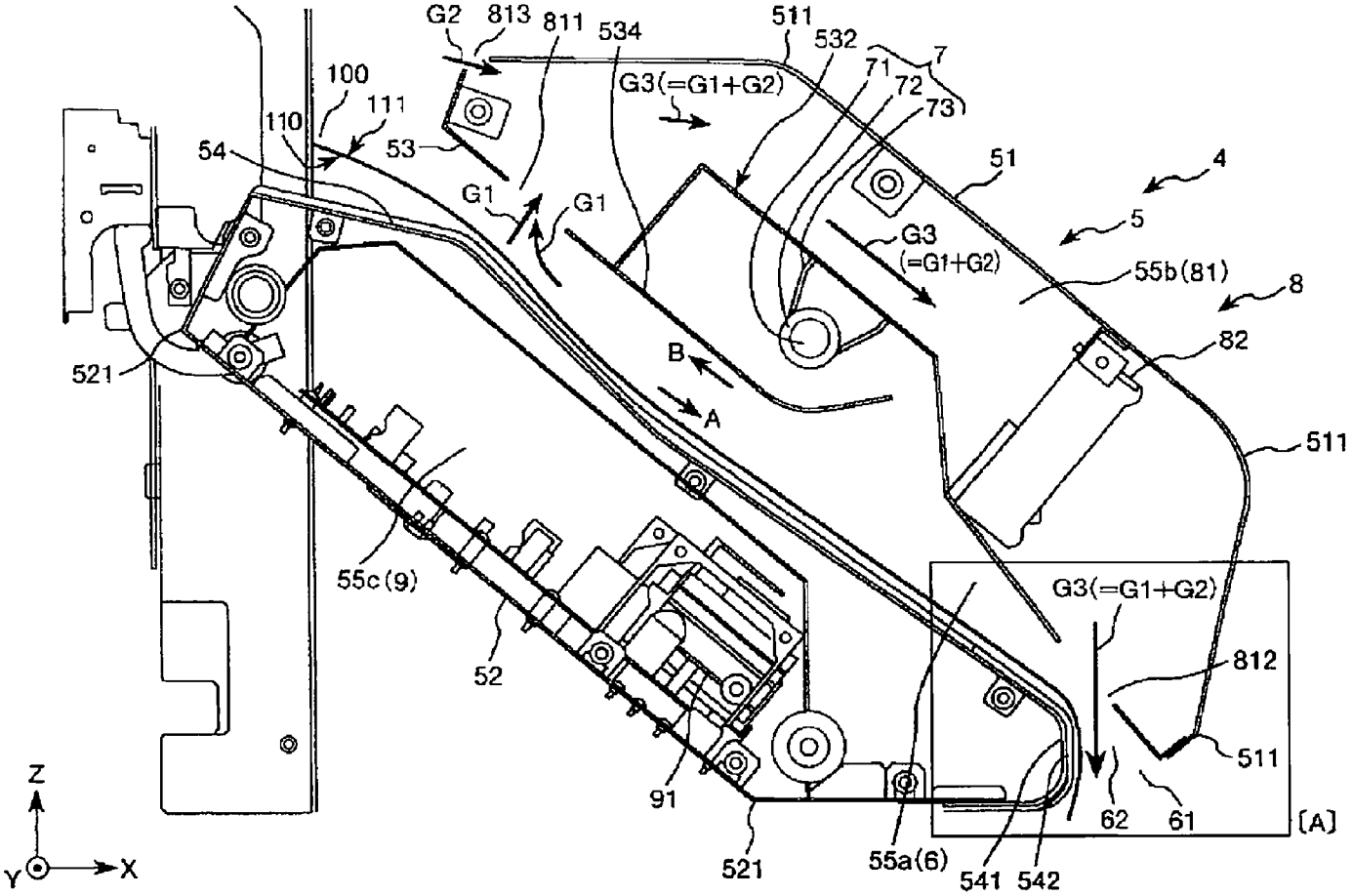
FIG. 3 is an exploded side view of a heating unit of the printing device according to the invention.

FIG. 1 is a perspective view of the printing device according to the invention, FIG. 2 is a sectional view of A-A line of FIG. 1 (schematic cross-sectional view), and FIG. 3 is an exploded side view of a heating unit of the printing device according to the invention. In the following, an X axis, a Y axis, and a Z axis are illustrated as three axes that are orthogonal with respect to each other in FIGS. 1-3 for convenience of explanation. The X axis is an axis along one of horizontal directions (a width (depth) direction of the printing device). The Y axis is an axis along a direction that is a horizontal direction and is perpendicular to the X axis (a longitudinal direction of the printing device). The Z axis is an axis along a vertical direction (an up and down direction). The tip end side of each arrow illustrated in the drawings is a "positive side (+side)", and the base end side thereof is a "negative side (−side)". Also, the upper side in FIGS. 1-3 is referred to as "up (upward)", and the lower side is referred to as "down (downward)"

As shown in FIGS. 1-3, the printing device 1 has a device main body 2, a leg portion (stand) 3, and a heating unit 4. The printing device 1 is a device for applying ink onto a recording medium 100 and conducting color printing by an inkjet method. Hereinafter, a configuration of each element will be explained. As described above, the printing device 1 has the device main body 2, the leg portion (stand) 3, and the heating unit 4 (see FIG. 1).

As shown in FIG. 2, the device main body 2 has a feed means (unit) 21, a pre-heater 25, a print section 11, and a casing body (housing) 29. The casing body 29 is a box-shaped member that collectively accommodates the feed means (unit) 21, the pre-heater 25, and the print section 11. The outer shape of the casing body 29 (the device main body 2) is an elongated shape along the Y axis direction.

The feed means (unit) 21 for feeding the recording medium 100 has rollers 211, 212 disposed vertically. One of the rollers 211, 212 is a main driving roller that is coupled with a motor through a speed reducer mechanism such as a gear. The other of the rollers 211, 212 is a driven roller. The main driving roller rotates in a state in which the recording medium 100 is sandwiched by the main driving roller and the driven roller so as to feed, that is, send out the recording medium 100 together with the driven roller. Hereinafter, a direction of feeding the recording medium 100 is referred to as a "feed direction".

The pre-heater 25 is provided for heating the recording medium 100 in advance before conducting printing to the recording medium 100. The pre-heater 25 has a housing 252 provided with an abutting surface 251 against which a back surface 110 of the recording medium 100 abuts, and a heat generator 253 accommodated within the housing 252. The abutting surface 251 is configured as a curved surface of an arch shape. The recording medium 100 abuts against the abutting surface 251 while being fed by the feed means (unit) 21. In this instance, heat from the heat generator 253 is transferred to the recording medium 100 through the abutting surface 251. Consequently, the recording medium 100 can be heated. Here, the surface temperature of the recording medium 100 when heated is preferably in the range of 45 degrees to 55 degrees. In order to dry a medium of a high heat resisting temperature, however, it is more preferably in the range of 60 degrees to 70 degrees.

Preferably, the curvature of the abutting surface 251 gradually decreases toward the downstream side in the feed direction, that is, toward the X axis positive direction. The constituent material of the housing 252 is not limited to a specific one. For example, aluminum, an aluminum alloy, stainless steel, or the like can be used. The heat generator 253 generates heat by applying electricity thereto, and is made of a metal material of relatively high electric resistance such as nichrome wire.

The print section 11 conducts printing by ejecting ink onto the recording medium 100 fed by activation of the feed means (unit) 21. The print section 11 has a carriage 22, a liquid drop ejecting head 23, a platen 24, a drying heater 26, a blowing fan 27, and a suction fan 28. The platen 24 is disposed on the downstream side in the feed direction with respect to the pre-heater 25. The platen 24 is made of a sheet material, and supports the recording medium 100 from below when ink is applied onto the recording medium 100. The platen 24 can be made of the same material as that of the housing 252, for example. A great number of opening portions (not shown in the drawings) that open an upper surface 241 are formed in the platen 24. Preferably, these opening portions are arranged in a matrix shape along a surface direction of the platen 24.

The suction fan 28 is disposed below the platen 24. The recording medium 100 on the platen 24 can be suctioned through each of the opening portions of the platen 24 by causing the suction fan 28 to be activated, that is, be rotated. With this, the position of the recording medium 100 when ink is applied can be stabilized, and thus the ink is applied reliably to a desired location of the recording medium 100. Here, the suction fan 28 is not limited to a specific one, and various kinds of fans such as a multiblade fan (sirocco fan) can be used, for example.

The carriage 22 supports the liquid drop ejecting head 23. The carriage 22 can move back and forth along the Y axis direction together with the liquid drop ejecting head 23 by activation of a movement mechanism that has a motor, a ball screw coupled with the motor, and a linear guide arranged parallel to the ball screw, for example. Printing can be conducted to the recording medium 100 with ink by ejecting ink from the liquid drop ejecting head 23 in a state in which the recording medium 100 is being fed in the X axis positive direction during the back-and-forth movement.

The liquid drop ejecting head 23 is disposed above the platen 24. The liquid drop ejecting head 23 has a great number of nozzle ports (not shown in the drawings) that open downward, and ink can be ejected from each nozzle port onto the recording medium 100 as liquid drops. Each of the nozzle ports of the liquid drop ejecting head 23 is coupled with a set of ink (cartridge) through a tube 231. With this, ink can be supplied to each nozzle port and printing can be conducted to the recording medium 100. Consequently, the recording medium 100 is for one-sided printing and has a print surface 111 on the front surface side.

The drying heater 26 is disposed to face the platen 24 in a state in which the liquid drop ejecting head 23 is interposed therebetween. The drying heater 26 accelerates drying of ink by emitting infrared rays toward the ink while the ink is being applied onto the recording medium 100. The drying heater 26 has a pipe body 261 disposed along the Y axis direction, and a heat generator 262 disposed such that the heat generator 262 is inserted into the pipe body 261.

The pipe body 261 is made of a metal material, and preferably, is made of inconel. Also, preferably, the entire length in the Y axis direction of the pipe body 261 is sufficiently longer than the width in the Y axis direction of the recording medium 100. Consequently, infrared rays can be reliably emitted toward the entire ink on the recording medium 100 that passes below the pipe body 261 (the drying heater 26). The heat generator 262 generates heat by applying electricity thereto, and is made of a heating element such as nichrome wire. When the heat generator 262 generates heat, the pipe body 261 is heated and infrared rays are emitted. Consequently, moisture or the like of ink can be reliably evaporated, and thus the ink can be dried. Here, the heating temperature of the pipe body 261 when heated is preferably in the range of 200 degrees to 400 degrees, for example. More preferably, it is in the range of 250 degrees to 350 degrees. Also, the surface temperature of the recording medium 100 when heated by the heat generator 262 is preferably in the range of 40 degrees to 60 degrees. More preferably, it is 50 degrees or less.

In order to dry ink on the recording medium 100, it is also conceivable that heating is conducted from the back surface 110 side of the recording medium 100, that is, the platen 24 is configured to serve as a heating plate. In such a case, however, there is fear that a film will be generated in ink due to the properties of the ink, which will prohibit evaporation of moisture or the like in the ink by the film. Therefore, in order to dry ink, the configuration of the present embodiment in which heating is conducted from the print surface 111 side (the front surface side) of the recording medium 100 is preferable.

The blowing fan 27 is disposed on the upstream side in the feed direction above the device main body 2. The blowing fan 27 blows wind 271 along the feed direction. Vapor generated by heating ink can be pushed outside the device main body 2 with the wind 271. Consequently, condensation can be prevented from occurring in the liquid drop ejecting head 23. Here, various kinds of fans such as a multiblade fan can be used as the blowing fan 27 in the same manner as the suction fan 28.

The device main body 2 configured as above is supported by the leg portion 3 from below (see FIG. 1 and FIG. 2). The leg portion 3 is constructed of a frame portion 31, four casters 32, and two adjuster feet (fixing tools) 33. The frame portion 31 is an assembly in which a plurality of bar-shaped members 311 are assembled by being appropriately coupled and fixed. The casters 32 are spaced apart from each other and fixed to the lower part of the frame portion 31. With this configuration, the printing device 1 can be delivered.

The adjuster feet 33 are also fixed to the lower part of the frame portion 31. The adjuster feet 33 are disposed in the vicinity of two casters 32, that are located on the X axis negative side, of the four casters 32. In order to regulate movement of the printing device 1, that is, fix the printing device 1 after delivering the printing device 1, the regulation can be performed by causing the adjuster feet 33 to abut against the floor surface.

The heating unit 4 is disposed on the downstream side in the feed direction with respect to the device main body 2. The heating unit 4 heats and dries the recording medium 100 to which printing has been conducted in the device main body 2 so as to fix the ink on the recording medium 100. As shown in FIG. 2 and FIG. 3, the heating unit 4 has a casing body (housing) 5, a heating means (unit) 7, and an air discharging means (unit) 8. As shown in FIG. 3, the casing body 5 has an upper exterior 51, and a lower exterior 52 provided below the upper exterior 51.

The upper exterior 51 has bending points 511 in a plurality of locations thereof, and the bending points 511 are bent or curved in the same direction. Also, the lower exterior 52 has bending points 521 in a plurality of locations thereof, and the bending points 521 are bent or curved in a direction opposite to that of the bending points 511 of the upper exterior 51. The casing body 5 has a box shape as a whole by the upper exterior 51 and the lower exterior 52. The casing body 5 (the heating unit 4) has an elongated shape along the Y axis direction, and the length thereof is smaller than the casing body 29 (the device main body 2).

An upper plate 53 and a lower plate 54 are provided inside the casing body 5 to divide into three spaces 55*a*, 55*b*, and 55*c*. The upper plate 53 and the lower plate 54 are disposed to face each other, and the lower plate 54 is disposed below the upper plate 53. The space 55*a* enclosed by the upper plate 53 and the lower plate 54 serves as a medium passage 6 for allowing the recording medium 100 after printing passes therethrough. The space 55*b* enclosed by the upper plate 53 and the upper exterior 51 serves as an air passage 81 for allowing air G1 in the medium passage 6 to pass therethrough so as to be forcibly discharged by the air discharging means (unit) 8. The space 55*c* enclosed by the lower plate 54 and the lower exterior 52 serves as an accommodating space 9 for accommodating electronic devices such as a smoke detector 91.

A recessed portion 532 that is recessed toward the upper exterior 51 is formed in the vicinity of the center of the upper plate 53 in the inclination direction. A heat generator 71 of the heating means (unit) 7 is accommodated in the recessed portion 532. The constituent material of the casing body 5 is not limited to a specific one. For example, aluminum, an aluminum alloy, stainless steel, or the like can be used.

The medium passage 6 will be explained. As shown in FIG. 3, the medium passage 6 allows the recording medium 100 to pass in an arrow A direction of FIG. 3. The medium passage 6 has a discharging port 61 for discharging the recording medium 100 provided in a portion on the downstream side in the feed direction. The medium passage 6 is inclined with respect to the horizontal direction. The discharging port 61 is located on the lower side in the inclination direction. With the configuration in which the medium passage 6 is inclined, the recording medium 100 can be guided to smoothly slide down to the discharging port 61 along the inclination direction.

The medium passage 6 has a gradually increasing portion 62 whose cross-sectional area gradually increases toward the discharging port 61. The gradually increasing portion 62 is disposed in the vicinity of the discharging port 61. A portion of the lower plate 54 facing the gradually increasing portion 62 serves as a curved portion 541. The recording medium 100 is discharged to the outside along a curved shape of the curved portion 541 when the recording medium 100 is discharged from the discharging port 61. Therefore, unwanted bending can be prevented from occurring in the recording medium 100.

A sheet member 542, in which fine irregularities are formed, is attached to the curved portion 541. With these irregularities, the back surface of the recoding medium 100 can be controlled or prevented from sticking to the sheet member 542 when the recoding medium 100 is discharged to the outside along the curved portion 541. As a result of this, the recording medium 100 can be smoothly discharged from the discharging port 61. As shown in FIG. 3, in the present embodiment, the sheet member 542 extends to a portion on the upstream side in the feed direction of the lower plate 54 with respect to the curved portion 541. Preferably, the above-described irregularities are formed in this extending portion of the sheet member 542. With this configuration, the recoding medium 100 can be extensively prevented from sticking in the vicinity of the discharging port. The method for forming the irregularities is not limited to a specific one. However, an emboss process, a satin process, or the like can be listed, for example.

Next, the heating means (unit) 7 will be explained. As shown in FIG. 3, the heating means (unit) 7 has a pipe body 72 that is disposed along the Y axis direction, a heat generator 71 that is inserted into the pipe body 72, and a support 73 that supports the pipe body 72. The pipe body 72 is made of a metal material, and preferably, is made of iron. Also, preferably, the entire length in the Y axis direction of the pipe body 72 is sufficiently longer than the width in the Y axis direction of the recording medium 100. Consequently, infrared rays can be reliably emitted toward the entire ink on the recording medium 100 that passes below the pipe body 72.

The heat generator 71 generates heat by applying electricity thereto, and is made of a heating element such as nichrome wire. When the heat generator 71 generates heat, the pipe body 72 is heated and infrared rays are emitted. Consequently, moisture or the like of ink can be reliably evaporated, and thus the ink can be dried. The support 73 supports the pipe body 72 from above, and is coupled with the recessed portion 532.

With the configuration in which the heat generator 71 is disposed above the medium passage 6, the print surface 111 of the recording medium 100, that passes through the medium passage 6, can be irradiated with infrared rays, and thus curing (solidification) can be caused in a resin component of ink. As a result of this, the recording medium 100 on which ink has cured (has been solidified) becomes excellent in weather resistance and abrasion resistance. Also, by providing the heating means (unit) 7 of this configuration in addition to heating by the above-described drying heater 26, moisture or the like of ink, that has not been dried out by the drying heater 26, can be reliably evaporated. As a result of this, ink on the recording medium 100 can be reliably dried.

The heating temperature of the pipe body 72 when heated is preferably in the range of 300 degrees to 700 degrees, for example. Also, the surface temperature of the recording medium 100 when heated is preferably in the range of 80 degrees to 120 degrees. More preferably, it is in the range of 90 degrees to 110 degrees. The surface temperature of the recording medium 100 can be detected by using an infrared ray sensor (IR sensor), for example. Further, in order to set the surface temperature of the recording medium 100 in the above-described numerical range, ON/OFF of the heating means (unit) 7 can be switched appropriately based on detection results of the infrared ray sensor.

A cover member 534 is provided in the medium passage 6 to cover the pipe body 72 accommodated in the recessed portion 532. Consequently, for example, even in a case in which a jam of the recording medium 100 occurs in the medium passage 6, the recording medium 100 can be prevented from directly contacting the pipe body 72. Further, when conducting maintenance or the like of the inside of the heating unit 4, an operator can be protected from directly touching the heat generator 71, and thus the operator can be protected from suffering from burn.

The cover member 534 has a mesh pattern. Consequently, infrared rays from the heat generator 71 can be prevented from being blocked by the cover member 534, and thus infrared rays can be emitted appropriately toward the recording medium 100. In order to heat the recording medium 100 after printing, it is also conceivable that heating is conducted from the back surface 110 side of the recording medium 100 to which one-sided printing has been conducted. In such a case, however, there is fear that a film will be generated in ink due to the properties of the ink, which will prohibit evaporation of moisture or the like in the ink with this film. Therefore, the configuration of the present embodiment in which heating is conducted from the print surface 111 side (the front surface side) of the recording medium 100 is preferable.

Next, the air discharging means (unit) 8 will be explained. The air discharging means (unit) 8 forcibly discharges the air G1 in the medium passage 6. As shown in FIG. 3, the air discharging means (unit) 8 has the air passage 81 and a fan 82. The air passage 81 allows the air G1 in the medium passage 6 to pass therethrough so as to be forcibly discharged. As described above, the air passage 81 is constructed of the space 55*b* enclosed by the upper plate 53 and the upper exterior 51 and is independent of the medium passage 6. The air passage 81 has an air aspirating port 811, an air discharging port 812, and an auxiliary air aspirating port 813.

The air aspirating port 811 aspirates the air G1 in the medium passage 6. The air aspirating port 811 is coupled with the medium passage 6 and is provided to open the upper plate 53. The auxiliary air aspirating port 813 aspirates outside air G2 toward the air passage 81. The auxiliary air aspirating port 813 is provided to open the upper exterior 51 on the upper side in the inclination direction with respect to the air aspirating port 811.

The air discharging port 812 discharges air G3, in which the air G1 and the air G2 are mixed, from the downstream side of the medium passage 6 to the outside. The air discharging port 812 is coupled with the medium passage 6 and is provided to open the upper plate 53 on the lower side in the inclination direction with respect to the air aspirating port 811. The air discharging port 812 is provided to face the curved portion 541. The fan 82 generates an air flow from the air aspirating port 811 side toward the air discharging port 812 side. The fan 82 is disposed in an intermediate position of the air passage 81. Preferably, the fan 82 is disposed on the lower side in the inclination direction with respect to the recessed portion 532. As the fan 82, for example, a centrifugal fan such as a sirocco fan or a turbo fan, an axial flow fan, a mixed flow fan, or the like can be used. In the air discharging means (unit) 8 configured above, the air G1 in the medium passage 6 is forcibly aspirated into the air passage 81 through the air aspirating port 811 by activation (rotation) of the fan 82.

Incidentally, the air G1 contains moisture or the like generated by evaporation of ink when being heated in the medium passage 6. This air G1 is aspirated into the air passage 81 through the air aspirating port 811. Consequently, condensation can be controlled or prevented from occurring in the medium passage 6. In particular, in a case in which ink for conducting printing to the recording medium 100 contains a relatively large amount of water as described below, this effect of preventing condensation becomes significant.

When the air G1 is aspirated into the air passage 81 by activation (rotation) of the fan 82, an air flow in an arrow B direction of FIG. 3 is generated in the medium passage 6. Consequently, the direction for delivering the recording medium 100 (the arrow A direction of FIG. 3) and the direction for flowing air in the medium passage 6 (the arrow B direction of FIG. 3) are opposite to each other in the medium passage 6, so that ink on the recording medium 100 can be efficiently dried. In particular, in a case in which ink for conducting printing to the recording medium 100 contains a relatively large amount of water as described below, this effect of preventing condensation becomes significant.

On the other hand, as the air G1 is aspirated into the air passage 81 by activation (rotation) of the fan 82, the outside air G2 is forcibly aspirated into the air passage 81 through the auxiliary air aspirating port 813. Then, the air G3 in which the air G1 and the air G2 are mixed in the medium passage 6 passes through the air passage 81. Although the upper exterior 51 is heated by heat transfer of the heating means (unit) 7, such heating is controlled by the air G3. Here, the surface temperature of the upper exterior 51 at this time is usually controlled to be 100° C. or less. However, it is preferably 70° C. or less.

As described above, the discharge port 61 faces the curved portion 541 of the medium passage 6. Therefore, the air G3 is discharged toward the curved portion 541 through the air discharging port 812. Consequently, the recording medium 100 is discharged to the outside in a state of being pushed onto the curved portion 541. In this instance, for example, even if the recording medium 100 is warped in the process of heating and might be discharged in such a state, the warpage will be corrected because the recording medium 100 is pushed onto the curved portion 541 by the air G3. In this manner, since the recording medium 100 is corrected in the opposite direction with respect to the warpage, the recording medium 100 can be smoothly discharged from the discharging port 61.

Figure 4:
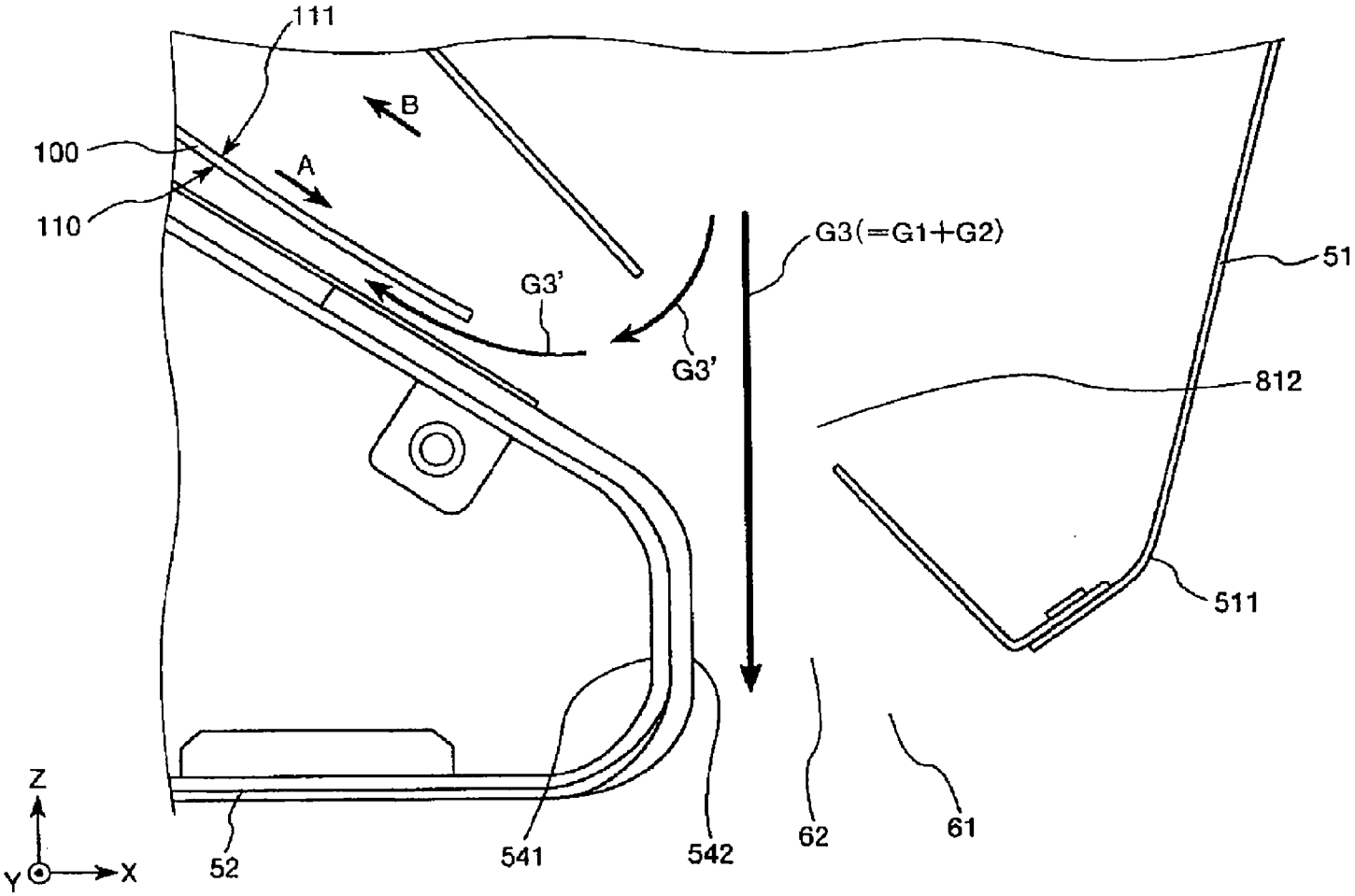
FIG. 4 is an enlarged detail view of region "A" enclosed by a one dot chain line of FIG. 3.

Also, as shown in FIG. 4, part G3' of the air G3 enters the back surface 110 side of the recording medium 100 before the recording medium 100 is pushed onto the curved portion 541. Consequently, the back surface of the recoding medium 100 can be controlled or prevented from sticking to the curved portion 541 before the recoding medium 100 is discharged to the outside along the curved portion 541. Also, as described above, irregularities are formed in the curved portion 541. In the printing device 1 (the heating unit 4), the back surface of the recoding medium 100 can be more reliably prevented from sticking to the curved portion 541 due to synergistic effects of the air G3' entering the back surface 110 of the recording medium 100 and the irregularities formed in the curved portion 541.

Next, ink and the recording medium 100 will be explained.

<Ink>

First, ink will be explained. Ink applied to the printing device of the invention is not limited to a specific one. However, it is preferable to use ink that contains a coloring agent, resin particles, a solvent, and an aprotic polar solvent. In a case in which ink of this configuration is used, the above-described effect of the printing device of the invention can be significantly exerted.

Hereinafter, each component will be explained.

[Coloring Agent]

Preferably, the ink contains a coloring agent. As the coloring agent, a pigment and a dye can be listed.

(Pigment)

A pigment has properties that discoloration will not easily occur with respect to light, gas, or the like as well as insolubility or slight solubility to water. Therefore, a recording material to which recoding has been conducted with ink using a pigment has good water resistance, gas resistance, light resistance, and preservation stability.

As the pigment, either one of an inorganic pigment and an organic pigment can be used. The inorganic pigment is not limited to a specific one. However, carbon black, iron oxide, titanium oxide, or the like can be listed. Among these, carbon black is preferable because the color development properties are good and sedimentation will not easily occur due to the small specific gravity when dispersed. Examples of the carbon black include furnace black, lamp black, acetylene black, and channel black (C. I. pigment black 7). Also, examples of a commercial product of the carbon black include No. 2300, 900, MCF88, No. 20B, No. 33, No. 40, No. 45, No. 52, MA7, MA8, MA100, and No. 2200B (trade names, manufactured by Mitsubishi Chemical Corporation), Color Black FW1, FW2, FW2V, FW18, FW200, S150, 5160, S170, PRETEX 35, U, V, 140U, and Special Black 6, 5, 4A, 4, 250 (trade names, manufactured by Degussa AG), Conductex SC and Raven 1255, 5750, 5250, 5000, 3500, 1255, 700 (trade names, manufactured by Columbian Carbon Japan Ltd.), REGAL 400R, 330R, 660R, MOGUL L, MONARCH 700, 800, 880, 900, 1000, 1100, 1300, 1400, and ELFTEX 12 (trade names, manufactured by Cabot Corporation).

Examples of the organic pigment include a quinacridone pigment, a quinacridonequinone pigment, a dioxazine pigment, a phthalocyanine pigment, an anthrapyrimidine pigment, an anthanthrone pigment, an indanthrone pigment, a flavanthrone pigment, a perylene pigment, a diketopyrrolopyrrole pigment, a perinone pigment, a quinophthalone pigment, an anthraquinone pigment, a thioindigo pigment, a benzimidazolone pigment, an isoindolinone pigment, an azomethine pigment, and an azo pigment. The organic pigment is preferably used in the invention because the color development properties are good and sedimentation will not easily occur due to the small specific gravity when dispersed.

Specific examples of the organic pigment include the following. Examples of the organic pigment used in cyan ink include C. I. Pigment Blue 1, 2, 3, 15, 15:1, 15:2, 15:3, 15:4, 15:6, 15:34, 16, 18, 22, 60, 65, 66, and C. I. Vat Blue 4, 60. Examples of the organic pigment used in magenta ink include C. I. Pigment Red 1, 2, 3, 4, 5, 6, 7, 8, 9, 10, 11, 12, 14, 15, 16, 17, 18, 19, 21, 22, 23, 30, 31, 32, 37, 38, 40, 41, 42, 48 (Ca), 48 (Mn), 57 (Ca), 57:1, 88, 112, 114, 122, 123, 144, 146, 149, 150, 166, 168, 170, 171, 175, 176, 177, 178, 179, 184, 185, 187, 202, 209, 219, 224, 245, 254, 264, and C. I. Pigment Violet 19, 23, 32, 33, 36, 38, 43, 50.

Examples of the organic pigment used in yellow ink include C. I. Pigment Yellow 1, 2, 3, 4, 5, 6, 7, 10, 11, 12, 13, 14, 16, 17, 24, 34, 35, 37, 53, 55, 65, 73, 74, 75, 81, 83, 93, 94, 95, 97, 98, 99, 108, 109, 110, 113, 114, 117, 120, 124, 128, 129, 133, 138, 139, 147, 151, 153, 154, 155, 167, 172, 180, 185, 213. As the pigment used in ink of color such as green ink or orange ink other than the above, a well-known pigment can be listed. A single kind of pigment can be used, or a combination of two or more kinds of pigments can be used.

(Dye)

Examples of the dye include an acid dye, a direct dye, a reactive dye, and a basic dye. Specific examples of the dye include C. I. Acid Yellow 17, 23, 42, 44, 79, 142, C. I. Acid Red 52, 80, 82, 249, 254, 289, C. I. Acid Blue 9, 45, 249, C. I. Acid Black 1, 2, 24, 94, C. I. Food Black 1, 2, C. I. Direct Yellow 1, 12, 24, 33, 50, 55, 58, 86, 132, 142, 144, 173, C. I. Direct Red 1, 4, 9, 80, 81, 225, 227, C. I. Direct Blue 1, 2, 15, 71, 86, 87, 98, 165, 199, 202, C. I. Direct Black 19, 38, 51, 71, 154, 168, 171, 195, C. I. Reactive Red 14, 32, 55, 79, 249, and C. I. Reactive Black 3, 4, 35. A single kind of dye can be used, or a combination of two or more kinds of dyes can be used. Preferably, the content of the coloring agent contained in the ink is in the range of 0.1 mass % to 7 mass %.

[Resin Particle]

Preferably, the ink contains resin particles. The abrasion resistance of a recording material can be made excellent by causing the ink to contain resin particles. The resin particles are mainly constructed of binder resin. The binder resin has effects of sufficiently fixing the ink onto the recording medium 100 so as to make the abrasion resistance of a recording material excellent by forming a resin coating film when the recording medium 100 is heated in inkjet recording. Preferably, the resin particles are constructed of binder resin in an emulsion state. Consequently, the viscosity of the ink becomes easy to adjust in an appropriate range in an inkjet recording method, and the preservation stability and the ejection stability of the ink can be made excellent.

In the present specification, "ejection stability" refers to properties in which constantly stable ink drops are ejected from a nozzle without occurring clogging of the nozzle. The binder resin is not limited to a specific one. However, thermoplastic resin is preferable. Consequently, the obtained recording material has more excellent abrasion resistance on the recording medium 100 that has no absorbency of ink or has low absorbency of ink.

Specific examples of the binder resin include a homopolymer or copolymer of (meth)acrylic acid, (meth)acrylic acid ester, acrylonitrile, cyanoacrylate, acrylamide, olefin, styrene, vinyl acetate, vinyl chloride, vinyl alcohol, vinyl ether, vinyl pyrrolidone, vinylpyridine, vinyl carbazole, vinyl imidazole, and vinylidene chloride, fluorine resin, and natural resin. Among these, at least either one of (meth) acrylic resin and styrene-(meth)acrylic acid copolymer resin is preferable, at least either one of acrylic resin and styrene-acrylic acid copolymer resin is more preferable, and styrene-acrylic acid copolymer resin is much more preferable. The copolymer described above can be in the form of any one of random copolymer, block copolymer, alternating copolymer, and graft copolymer. In the present specification, "(meth)acrylic" refers to at least either one of acrylic or methacrylic.

As the binder resin, one that is obtained by a well-known material and manufacturing method can be used, or a commercial product can be used. Examples of the commercial product include, but are not limited to, Microgel E-1002 and Microgel E-5002 (trade names, manufactured by Nippon Paint Co., Ltd.), Voncoat 4001 and Voncoat 5454 (trade names, manufactured by DIC Inc.), SAE1014 (trade name, manufactured by Zeon Corporation), Saivinol SK-200 (trade name, manufactured by SAIDEN CHEMICAL INDUSTRY CO., LTD.), and Joncryl 7100, Joncryl 390, Joncryl 711, Joncryl 511, Joncryl 7001, Joncryl 632, Joncryl 741 Joncryl 450, Joncryl 840, Joncryl 74J, Joncryl HRC-1645J, Joncryl 734, Joncryl 852, Joncryl 7600, Joncryl 775, Joncryl 537J, Joncryl 1535, Joncryl PDX-7630A, Joncryl 352J, Joncryl 352D, Joncryl PDX-7145, Joncryl 538J, Joncryl 7640, Joncryl 7641, Joncryl 631, Joncryl 790, Joncryl 780, Joncryl 7610 (trade names, manufactured by BASF).

The binder resin is not limited to a specific one. For example, the binder resin can be obtained by a preparing method described below, or a plurality of methods can be combined as needed. Examples of the preparing method include a method of mixing a polymerization catalyst (a polymerization initiator) and a dispersing agent in a monomer of the component constituting the desired resin so as to cause polymerization (emulsion polymerization), a method of mixing a solution, obtained by dissolving resin having a hydrophilic portion into a water-soluble organic solvent, in water and thereafter removing the water-soluble organic solvent by distillation or the like, and a method of mixing a solution obtained by dissolving resin into a water-insoluble organic solvent together with a dispersing agent in an aqueous solution.

The dispersing agent that can be used when dispersing the binder resin in an emulsion state is not limited to a specific one. However, examples of the dispersing agent include an anionic surface-active agent such as dodecyl benzene sulfonic acid sodium salt, lauryl phosphate sodium salt, and polyoxyethylene alkyl ether sulfate ammonium salt, and a nonionic surface-active agent such as polyoxyethylene alkyl ether, polyoxyethylene alkyl ester, polyoxyethylene sorbitan fatty acid ester, and polyoxyethylene alkyl phenyl ether. A single kind of dispersing agent can be used, or a combination of two or more kinds of dispersing agents can be used. The average particle size of the resin particles is preferably in the range of 5 nm to 400 nm, and more preferably in the range of 20 nm to 300 nm. As a result of this, the preservation stability and the ejection stability of the ink can be made more excellent.

The average particle diameter in the present specification refers to a value measured by a dynamic light scattering method. The content of the binder resin that can be contained in the ink (in terms of solid content) is preferably in the range of 0.5 mass % to 5 mass %, and more preferably in the range of 0.5 mass % to 1.5 mass %. When the content is in the above range, the abrasion resistance becomes more excellent.

[Solvent]

Preferably, the ink contains a solvent for dissolving or dispersing the coloring agent, the resin particles, and the like described above. The solvent is not limited to a specific one as long as it dissolves or disperses the coloring agent, the resin particles, and the like described above. It is however preferable to use water. By using water as the solvent, it is possible to suitably dissolve or disperse the coloring agent, the resin particles, and the like, thereby further improving the ejection stability of the ink. Further, since the ejection stability is improved, an image of better image quality can be formed. Examples of the water include pure water such as deionized water, ultrafiltration water, reverse osmosis water, or distilled water, and ultrapure water, in which ionic impurities are removed as much as possible. Also, when water is sterilized by ultraviolet irradiation or addition of hydrogen peroxide, the growth of mold or bacteria can be prevented in a case of long-term preservation of a pigment dispersion solution or ink using this solution.

[Aprotic Polar Liquid]

Preferably, the ink contains aprotic polar liquid. The aprotic polar liquid is a component having effects of assisting dissolution of the above-described resin particles contained in the ink and film-formation of ink on the recording medium through curing. In other words, the aprotic polar liquid is a component that serves as a film-forming assistant. The aprotic polar liquid is also a component for preventing clogging of a nozzle from occurring in inkjet printing. The aprotic polar liquid is not limited to a specific one. The aprotic polar liquid can be one or more kinds selected from a group consisting of pyrrolidone, lactone, sulfoxide, imidazolidinone, sulfolane, a urea derivative, dialkyl amide, cyclic ether, and amide ether. Among these, preferably, the aprotic polar liquid is pyrrolidone.

Specific examples of the pyrrolidone include 2-pyrrolidone, N-methyl-2-pyrrolidone, and N-ethyl-2-pyrrolidone. Among these, in particular, it is preferable to use 2-pyrrolidone. With this, the above-described effect becomes more significant. Specific examples of the lactone include γ-butyrolactone, γ-valerolactone, and ϵ-caprolactone. Specific examples of the sulfoxide include dimethyl sulfoxide and tetramethylene sulfoxide.

Specific examples of the imidazolidinone include 1,3-dimethyl-2-imidazolidinone. Specific examples of the sulfolane include sulfolane and dimethylsulfolane. Specific examples of the urea derivative include dimethyl urea and 1,1,3,3-tetramethyl urea.

Specific examples of the dialkyl amide include dimethylformamide and dimethylacetamide. Specific examples of the cyclic ether, 1,4-dioxane and tetrahydrofuran. Further, as the amide ether, a solvent or the like represented by the following general formula (1) can be listed.

[formula 1]

(1)

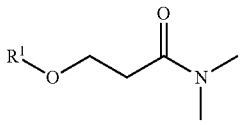

In formula (1), $R^1$ is preferably an alkyl group with a carbon number of 1 to 4. The "alkyl group with a carbon number of 1 to 4" can be a linear or branched alkyl group, and examples include a methyl group, an ethyl group, an n-propyl group, an iso-propyl, an n-butyl, an iso-butyl group, a sec-butyl group, and a tert-butyl group. Further, the solvent represented by formula (1) where $R^1$ is an alkyl group with a carbon number of 1 to 4 can impart appropriate pseudoplastic properties to the ink composition, and thus the excellent ejection stability of the ink can be obtained. Also, the solvent represented by formula (1) where $R^1$ is an alkyl group with a carbon number of 1 to 4 is preferable because the action of dissolving resin is particularly strong.

The HLB value of the solvent represented by formula (1) is preferably in the range of 10.5 to 20.0, and more preferably in the range of 12.0 to 18.5. In terms of appropriate pseudoplastic properties of the ink and interaction with the resin component, it is more preferable that the HLB value of the solvent represented by formula (1) is in the above range. Here, the HLB value of the solvent represented by formula (1) is a value calculated by the following equation from a ratio of an inorganic value (I) to an organic value (O) (hereinafter also simply referred to as "I/O value") in an organic conceptual diagram.

$$HLB \text{ value}=(\text{inorganic value}(I)/\text{organic value}(O))\times 10$$

Specifically, the I/O value can be calculated based on the literature: Atsushi Fujita, "Systematic Organic Qualitative Analysis Mixture Edition", Kazamashobo Co., Ltd. (1974); Nobuhiko Kuroki, "Dyeing Theoretical Chemistry", Maki Shoten (1966); or Hiroo Inoue, "Methods for Separating Organic Compounds", Shokabo Publishing Co., Ltd. (1990). Among the aprotic polar liquid, it is preferable to use one or more kinds selected from a group consisting of pyrrolidone, lactone, sulfoxide, and amide ether because the fixing property with respect to the recording medium 100 becomes excellent.

The boiling point of the aprotic polar liquid is in the range of 200° C. to 260° C. With this, since the effect of the film-forming assistant is more reliably exhibited until the ink cures, deterioration of the quality of the obtained image can be more reliably prevented. The content of the aprotic polar liquid contained in the ink is preferably in the range of 3 mass % to 30 mass %, and more preferably in the range of 8 mass % to 20 mass %.

[Moisturizing Agent]

The ink can contain a moisturizing agent. The moisturizing agent is not limited to a specific one, and for example, alkanediol, glycol ether, and the like can be listed. Examples of the alkanediol include 1,2-butanediol, 1,3-butanediol, 1,4-butanediol, 1,2-pentanediol, 1,3-pentanediol, 1,2-hexanediol, 1,5-pentanediol, 1,6-hexanediol, and 1,7-heptanediol.

Examples of the glycol ether include polyalkylene glycol such as diethylene glycol, dipropylene glycol, or dibutylene glycol. Examples of alkylene glycol monoether contained in the polyalkylene glycol include ethylene glycol monomethyl ether, ethylene glycol monoethyl ether, ethylene glycol monoisopropyl ether, ethylene glycol monobutyl ether, ethylene glycol monohexyl ether, ethylene glycol monophenyl ether, diethylene glycol monomethyl ether, diethylene glycol monoethyl ether, diethylene glycol monobutyl ether, diethylene glycol dimethyl ether, diethylene glycol diethyl ether, triethylene glycol monomethyl ether, triethylene glycol monoethyl ether, triethylene glycol monobutyl ether, tetraethylene glycol monomethyl ether, tetraethylene glycol monoethyl ether, propylene glycol monomethyl ether, propylene glycol monoethyl ether, dipropylene glycol monomethyl ether, and dipropylene glycol monoethyl ether.

Examples of alkylene glycol diether contained in the polyalkylene glycol include ethylene glycol dimethyl ether, ethylene glycol diethyl ether, ethylene glycol dibutyl ether, diethylene glycol dimethyl ether, diethylene glycol diethyl ether, diethylene glycol dibutyl ether, triethylene glycol dimethyl ether, triethylene glycol diethyl ether, triethylene glycol dibutyl ether, tetraethylene glycol dimethyl ether, tetraethylene glycol diethyl ether, tetraethylene glycol dibutyl ether, propylene glycol dimethyl ether, propylene glycol diethyl ether, dipropylene glycol dimethyl ether, and dipropylene glycol diethyl ether. Among these glycol ethers, polyalkylene glycol is preferable because it is excellent in moisturizing properties.

[Wax]

The ink can contain a wax. A wax imparts slip performance to a surface of a formed recording material and improves the abrasion resistance. Examples of the wax include a paraffin wax, a polyolefin wax, and the like.

(Paraffin Wax)

When the ink contains a paraffin wax, slip performance can be imparted to a surface of an obtained recording material (image) and the abrasion resistance can be improved. Also, since a paraffin wax is water-repellent, the water resistance of the recording material can be made excellent.

In the present specification, the "paraffin wax" refers to a so-called petroleum wax, and refers to a mixture of hydrocarbon having a weight average molecular weight in the range of around 300 to 500 in which the main component is linear paraffinic hydrocarbon (normal paraffin) having a carbon number in the range of around 20 to 30 and a small amount of iso paraffin is contained. The ink preferably contains the paraffin wax in an emulsion state. Thus, the viscosity of the ink can be easily adjusted to a proper range in an inkjet recording system, and the preservation stability and the ejection stability of the ink can be made more excellent.

In order to further strengthen the coating film of the recording material and further improve the abrasion resistance of the recording material, the melting point of the paraffin wax is preferably in the range of 110° C. or less. On the other hand, in order to prevent the surface to be recorded from being dried and becoming sticky, the lower limit of the melting point of the paraffin wax is preferably in the range of 60° C. or more. More preferably, in order to further improve the ejection stability of the ink, the above melting point is in the range of 70° C. to 95° C. The average particle size of the paraffin wax in an emulsion state is preferably in the range of 5 nm to 400 nm, and more preferably in the range of 50 nm to 200 nm. Thus, a stable emulsion state can be maintained. Further, the preservation stability and the ejection stability of the ink can further be improved.

A commercial product can be used as the paraffin wax. Examples of the commercial product include, but are not limited to, AQUACER537 and AQUACER539 (trade name, manufactured by BYK). The content of the paraffin wax that can be contained in the ink (in terms of solid content) is preferably in the range of 1.5 mass % or less, and more preferably in the range of 0.25 mass % to 0.75 mass %.

(Polyolefin Wax)

When the ink contains a polyolefin wax, the abrasion resistance of the recording material can be made more excellent. Examples of the polyolefin wax include, but are not limited to, a polyethylene wax and a polypropylene wax. Among these, a polyethylene wax is preferable.

According to an example of a method for producing a polyethylene wax, a polyethylene wax is produced by polymerizing ethylene or by decreasing the molecular weight of polyethylene for general molding through thermal decomposition. Then, by oxidizing the polyethylene wax so as to add a carboxyl group or a hydroxyl group thereto, and further causing emulsification to occur using a surface-active agent, the polyethylene wax can be formed in the form of an aqueous emulsion with excellent stability.

A commercial product can be used as the polyolefin wax. Among these, examples of a commercial product of a polyethylene wax include, but are not limited to, Nopcoat PEM 17 (trade name, manufactured by SANNOPCO LIMITED), CHEMIPEARL W4005 (trade name, Mitsui Chemicals, Inc.) and AQUACER515, AQUACER593 (trade names, manufactured by BYK).

The ink preferably contains the polyolefin wax in an emulsion state. Thus, the viscosity of the ink can be easily adjusted to a proper range in an inkjet recording system, and the preservation stability and the ejection stability of the ink can be made more excellent. The average particle size of the polyolefin wax in an emulsion state is preferably in the range of 5 nm to 400 nm, and more preferably in the range of 50 nm to 200 nm. Thus, the preservation stability and the ejection stability of the ink can further be improved.

The content of the polyolefin wax that can be contained in the ink (in terms of solid content) is preferably in the range of 1.5 mass % or less, and more preferably in the range of 0.25 mass % to 0.75 mass %. The ink can also contain a wax other than the polyolefin wax and the paraffin wax.

[Surface-Active Agent]

The ink can contain a surface-active agent. The surface-active agent is not limited to a specific one, but it is preferable to use a nonionic surface-active agent. The nonionic surface-active agent has the effect of spreading the ink uniformly on the recording medium 100. Therefore, when conducting inkjet printing using ink that contains a nonionic surface-active agent, a high-definition image with little blurring can be obtained.

Examples of the nonionic surface-active agent include, but are not limited to, an acetylene glycol surface-active agent, a silicon surface-active agent, a polyoxyethylene alkyl ether surface-active agent, a polyoxypropylene alkyl ether surface-active agent, a polycyclic phenyl ether surface-active agent, a sorbitan derivative, and a fluorine-containing surface-active agent. A single kind of surface-active agent or a combination of two or more kinds of surface-active agents can be used. It is sufficient for the content of the surface-active agent that can be contained in the ink to be in the range of 1.5 mass % or less.

[Other Components]

In addition to the above components, the ink can contain an organic solvent other than those described above, a pH adjusting agent, a preservative or a fungicide, a rust-preventive agent, a chelating agent, and the like.

<Recording Medium 100>

The recording medium 100, to which ink is applied, is loaded into the printing device 1 in a state of being wound in a roll shape. This recording medium 100 is suitable for inkjet recording using a recording medium having ink non-absorbing or low-absorbing properties as well as using a recording medium having ink absorbing properties.

Examples of the recording medium 100 having ink absorbing properties include, but are not limited to, plain paper, fine quality paper, and special paper for inkjet printing such as glossy paper. Examples of the recording medium 100 having ink low-absorbing properties include art paper, coated paper, and printing paper such as matte paper. Examples of the recording medium 100 having ink non-absorbing properties include, but are not limited to, a plastic film to which no surface treatment has been conducted for ink-jet printing (i.e., no ink absorbing layer has been formed), and one obtained by coating a base material such as paper with plastic or attaching a plastic film to a base material such as paper. Examples of the plastic include, but are not limited to, polyvinyl chloride, polyethylene terephthalate, polycarbonate, polystyrene, polyurethane, polyethylene, and polypropylene. The printing device of the invention was explained with reference to the illustrated embodiment. However, the invention is not limited to this. Each element of the printing device can be replaced with one having any configuration that can exert a similar effect. Also, any structure can be added.

As for the positional relationship between the air aspirating port and the air discharging port, the air aspirating port is provided on the upstream side in the feed direction with respect to the air discharging port in the present embodiment. However, the invention is not limited to this. For example, the air aspirating port can be provided on the downstream side in the inclination direction with respect to the air discharging port. In such a case, the feed direction of the recording medium and the air flow direction are the same within the medium passage. Consequently, the recording medium 100 can be more smoothly fed. Further, the air discharging means (unit) has a fan in the present embodiment. However, the invention is not limited to this. A blower or the like can be used instead of a fan.

What is claimed is:

1. A printing device, comprising:

a device main body that has a feeding unit configured and arranged to feed a recording medium and a printing section configured and arranged to print by ejecting ink from a liquid drop ejecting head onto the recording medium that has been fed by activation of the feeding unit; and a heating unit disposed on a downstream side in a feed direction of the recording medium with respect to the device main body, the heating unit having a medium passage, a heat generator, and an air passage provided independently of the medium passage, the medium passage being configured and arranged to pass the recording medium after printing therethrough, the heat generator being disposed between the medium passage and the air passage in a sectional view of the heating unit to heat the recording medium after printing with heat generated by the heat generator, and the air passage having an air aspirating port that is connected with the medium passage so as to aspirate air in the medium passage and an air discharging port that is provided in a position different from the air aspirating port so as to discharge air aspirated through the air aspirating port, with the air aspirating port being located on an upstream side in a feed direction of the recording medium with respect to the air discharging port.

2. The printing device according to claim 1, wherein the heating unit has an aspirating member that is disposed in an intermediate position of the air passage to aspirate air in the medium passage into the air passage.

3. The printing device according to claim 1, wherein the air passage has an auxiliary air aspirating port configured and arranged to aspirate outside air provided in a position different from the air aspirating port and the air discharging port.

4. The printing device according to claim 1, wherein the medium passage and the air passage are aligned with each other, and the heat generator is located close to the air passage.

5. The printing device according to claim 1, wherein the medium passage has a discharging port configured and arranged to discharge the recording medium provided in a portion on a downstream side in the feed direction, and also has a gradually increasing portion whose cross-sectional area gradually increases toward the discharging port, the gradually increasing portion being disposed in the vicinity of the discharging port.

6. The printing device according to claim 5, wherein a back surface of the recording medium for one-sided printing is pushed onto the gradually increasing portion by part of air discharged from the air discharging port.

7. The printing device according to claim 6, wherein part of air discharged from the air discharging port enters the back surface side of the recording medium for one-sided printing before the back surface of the recording medium for one-sided printing is pushed onto the gradually increasing portion by part of air discharged from the air discharging port.

8. The printing device according to claim 7, wherein the gradually increasing portion has fine irregularities.

9. The printing device according to claim 1, wherein the medium passage is inclined with respect to a horizontal direction.

10. The printing device according to claim 1, wherein the ink contains a coloring agent, resin particles, a solvent, and an aprotic polar solvent.

* * * * *